United States Patent [19]

Chien-Sheng

[11] 4,296,505

[45] Oct. 27, 1981

[54] STEPLESS CONTROLLED FLUSH CLOSET

[76] Inventor: Chiang Chien-Sheng, 6, Alley 15, La. 174, Ta Tung St., Peitu District, Taipei, Taiwan

[21] Appl. No.: 112,467

[22] Filed: Jan. 16, 1980

[51] Int. Cl.[3] ..... E03D 1/14; E03D 3/12

[52] U.S. Cl. ..... 4/324; 4/325; 4/386; 4/415

[58] Field of Search ..... 4/384, 386, 382, 415, 4/324, 325, 326, 327

[56] References Cited

U.S. PATENT DOCUMENTS

| | | | |
|---|---|---|---|
| 642,165 | 1/1900 | Schulte | 4/382 |
| 1,566,396 | 12/1925 | Gilmore | 4/382 |
| 2,270,989 | 1/1942 | Asselin | 4/382 |
| 2,922,168 | 1/1960 | Crandall | 4/384 |

*Primary Examiner*—Henry K. Artis

*Attorney, Agent, or Firm*—Robert E. Burns; Emmanuel J. Lobato; Bruce L. Adams

[57] ABSTRACT

The amount of water discharged from the tank of a flush toilet is controlled in a stepless manner by means of a rotary volume control lever concentric with the usual flushing handle. The volume control lever is connected with a slider on the arm of a float which floats at the surface of the water in the tank. The slider is connected by a lost-motion connection with a closure for the discharge opening of the tank. When the water level in the tank falls to a level determined by the position of the slider on the float arm, the closure, which has been opened by operation of the flushing handle, is closed to prevent further discharge, thereby conserving water.

4 Claims, 4 Drawing Figures

STEPLESS CONTROLLED FLUSH CLOSET

SUMMARY OF THE INVENTION

The invention relates to a new design of a stepless controlled water tank used in a flush closet which applies the principle of an adjustable slider which can slide on a water level control bar for controlling the discharge volume and time in order to save water consumption.

BRIEF DESCRIPTION OF THE DRAWINGS

FIG. 2(*b*) illustrates the discharging after volume control, and

DESCRIPTION OF A PREFERRED EMBODIMENT

Figure 1:
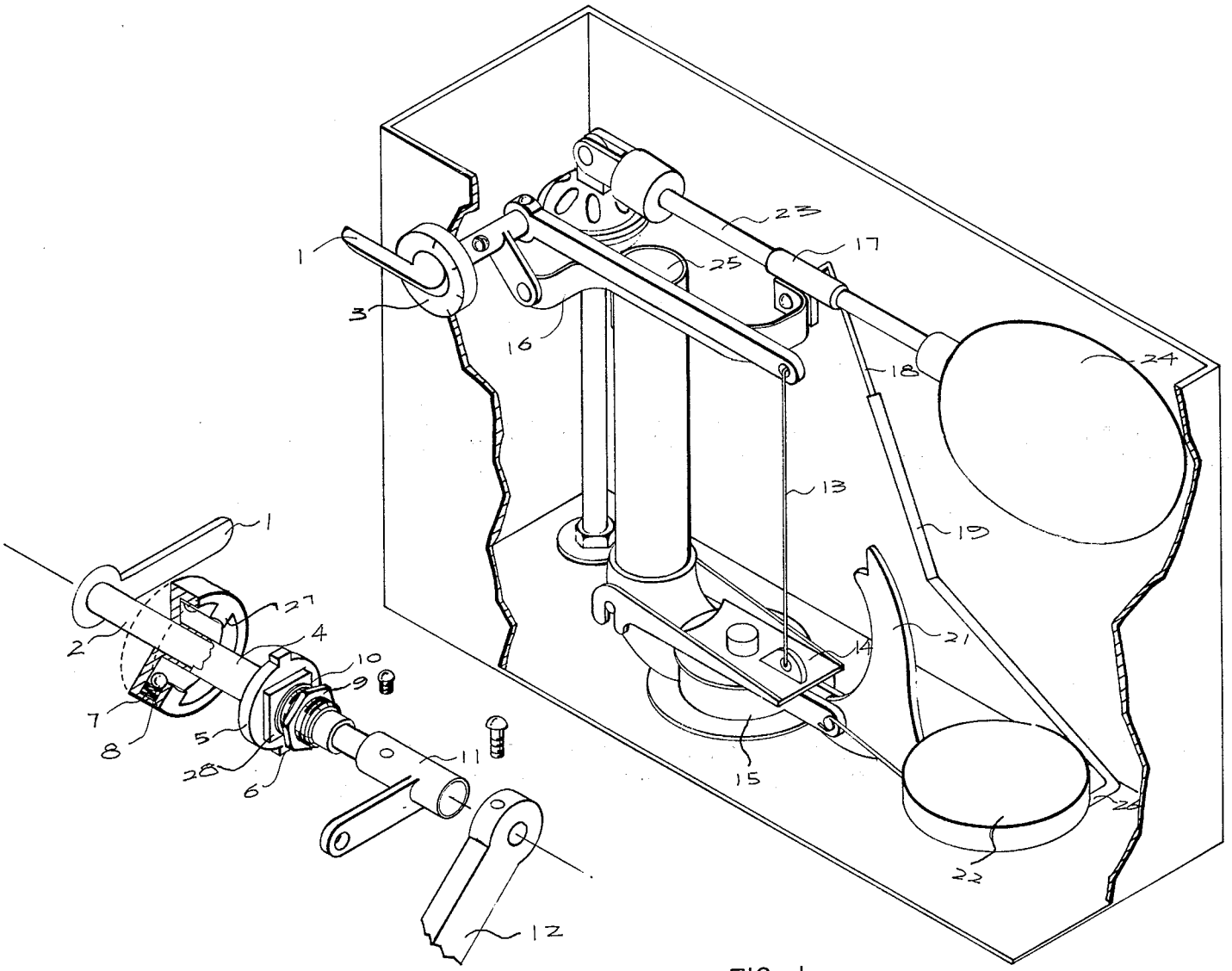
FIG. 1 is a schematic perspective view of an embodiment of the invention.

The invention relates to a new design of a stepless controlled water tank for a flush closet. It comprises a water level scale which is placed around a discharge lever of the water tank. A hollow shaft passes through the center of the scale. The scale has a concave interior surface, which has two flanges each 30° wide in its corresponding position. Each flange has a cavity which has a steel ball held in the cavity opening by the pressure of a spring. A screw-like positioning block is placed around the shaft. The positioning block has two corresponding projections each 15° wide at its head. The head of the positioning block is inserted into the concave surface. The water level scale is rotated in it. The positioning block has a square structure which has a thickness identical to the thickness of the tank wall and fixed to the wall by means of a washer and nut. The hollow shaft is surrounded by a T-fitting which is fixed by means of screws. The lower end of the T-fitting is connected to one end of a link, while the other end of the link is connected to a slider which slides on the arm of the conventional intake control float. The slider is connected to the upper end of lost motion linkage, the lower end of which is fixed to a coupling, while the coupling is fixed to a control block by means of screws. Whenever there is a sufficient volume of water in the water tank, the intake control float and the discharge float are floating. If the water volume scale is adjusted in a clockwise direction, the T is rotated simultaneously and so, the link is moved leftwards, the slider slides leftwards along the arm of the intake control float and one part of the lost motion linkage is pulled out. Then, when the discharge lever is operated for flushing, the rotating arm pulls up the discharge control link, so that the discharge control plate is lifted and retained by the flange of the control block which is held up by the floating of the discharge float. Suquentially, the water in the tank is discharged from the outlet pipe, the water level in the tank is lowered, the intake float moves downwards so that the lost motion linkage contracts until the intake control float falls a predetermined distance. Then the rear end of the control block is pressed downward so that the control block moves clockwise. Thus, the control plate swings down from the flange of the control block and covers the outlet pipe. In such a proceeding, the water level scale turns in the counterclockwise direction till the positioning block touches the flange of the scale. The water discharge volume will be a minimum when the slider is at the right side of the intake control float arm. Discharge volume increases if the scale is turned clockwise and the slider is moved leftwards. The scale can be turned through a range of 135°. When it has been turned 135° clockwise, the water discharge volume will be 100%. The spring and the steel ball in the flange of the water level scale can press the positioning block at all times so that the movement of the handle during flushing will not affect the scale and the accuracy of water discharge volume. Whenever termination of water discharge is required during flushing, only the water level scale has to be turned till the lost motion linkage is in its contracted position. The control block and the outlet pipe are connected by means of a spring and the control block is always at the upward position so that it is not necessary to use the outlet float.

In contrast with the single volume flushing in a conventional water tank for a water closet which means a waste of water, and the two-step discharge control as found in the market, the new stepless controlled water tank for a flush closet which uses a water level scale, positioning block, linkage, slider, and contractable linkage for optional stepless control of discharge volume makes possible a significant saving of water. Furthermore, the invention requires a simple alternation of a conventional water tank. Its cost is low but its efficiency is excellent.

A detailed description is given as follows with reference to the attached drawings:

As shown in FIG. 1, a water level scale (3), a positioning block (5), a washer (10), a nut (9), a T-fitting (11) and a rotating arm (12) are placed around the shaft (2) of a discharge lever (1) in sequence. The external surface of the water level scale (3) is engraved with a scale within a range of 135°. The scale has a concave interior surface. In two corresponding positions of the scale there are two flanges (27), each of which is 30° wide. In each flange (27) there is a spring (7) which forces a steel ball (8) to engage the head of a positioning block (5). The head of the positioning block has two corresponding projections (6), each of which is 15° wide. The head of the positioning block is inserted into the interior surface of the scale (3). A square block (28) on the positioning block (5) fits into a cavity of a water tank wall with an equal thickness. The positioning block (5) is fixed with the washer (10) and the nut (9) in the water tank. Then, the T-fitting (11) is placed on the shaft (4) and fixed with a screw. An arm of the T-fitting is engaged with a link (16). Another end of the link (16) is connected to the base of a cross slider (17), which is slidable on the arm (23) of an intake control float (24). The slider is also connected to an L-like contractible telescopic link, (18), (19). The lower end of the contractible link (18), (19) is connected to a coupling (20) by means of a crank (26). The coupling (20) is fixed to a control block (21).

Figure 2:
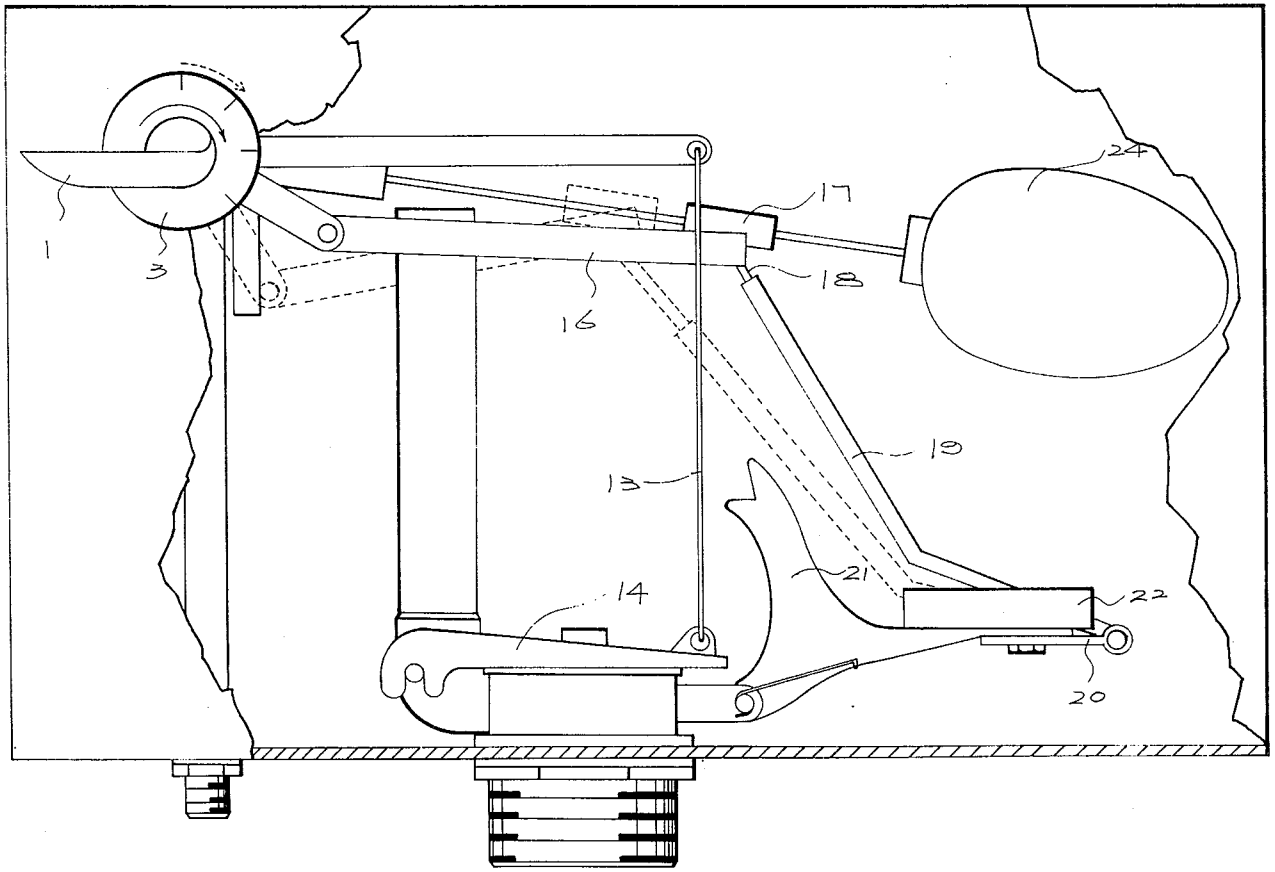
FIG. 2(*a*) illustrates the action of discharge volume control.
Figure 2B:
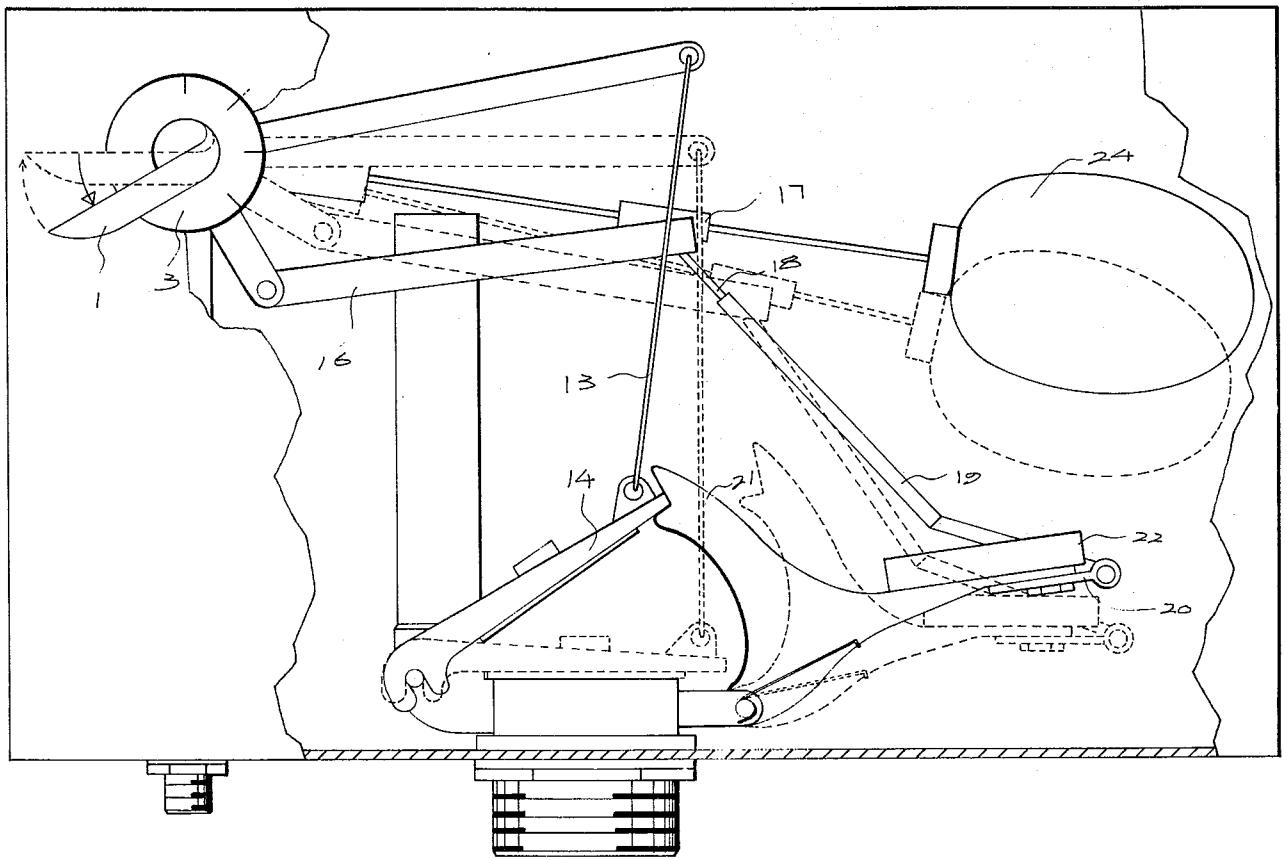
Figure 3:
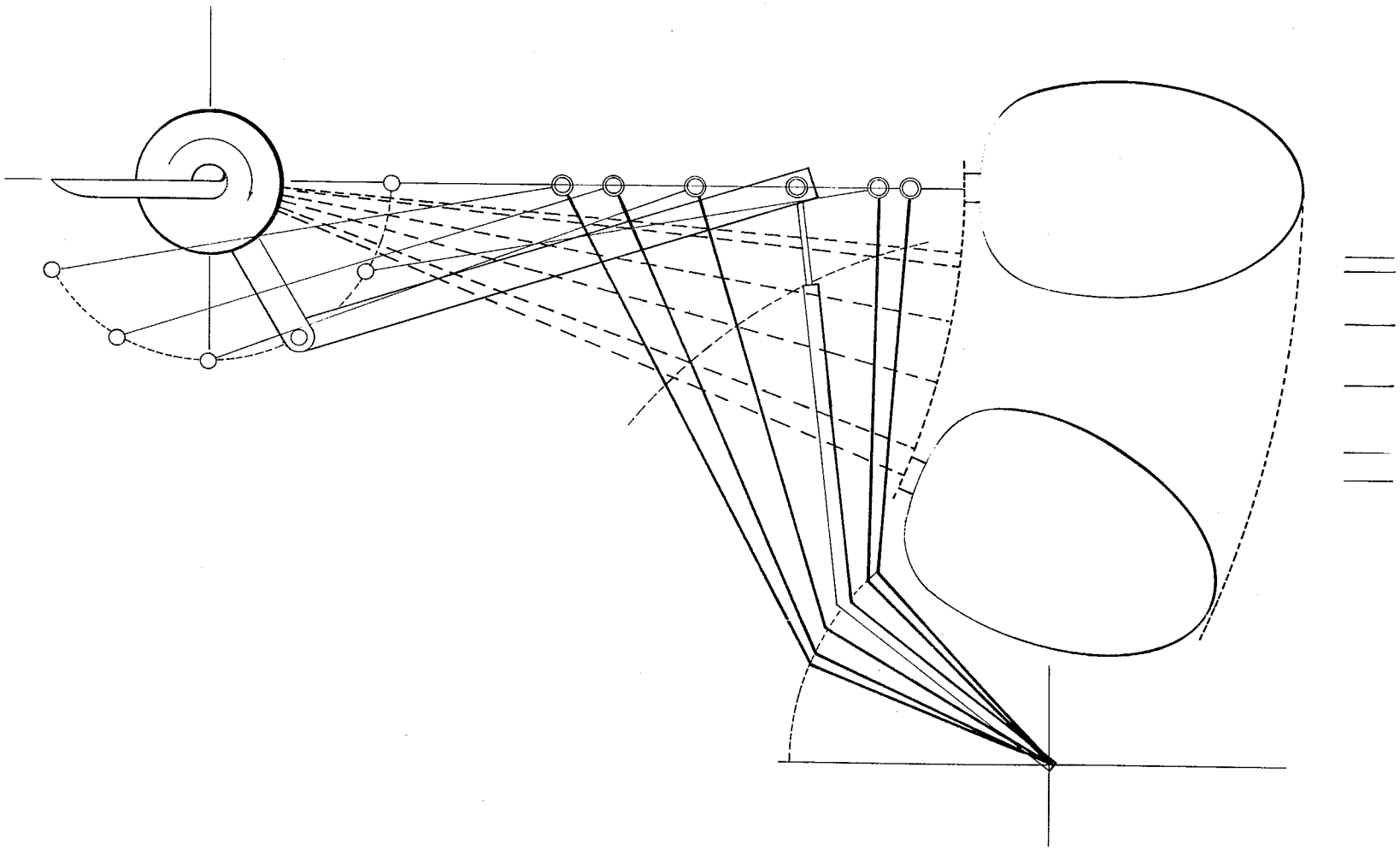
FIG. 3 illustrates the action of discharge volume control in accordance with the invention.

The procedure of operation is as follows:

Whenever there is a sufficient volume of water in the tank, the discharge float (22) and the intake control float (24) are floating. When the water level scale (3) is turned in the clockwise direction, then through the turning of T-fitting (11), the link (16) is moved leftward so that the slider (17) is slid leftward along the arm (23) of the intake control float (24), and the upper part (18)

of the telescopic link is partly withdrawn from the lower part (19). As shown in FIG. 2(*a*), when the discharge lever (1) is operated, the turning of rotating arm (12) lifts the pulling link (13). The discharge control plate (14) is thus opened and engages the flange of a control block (21). Therefore, the water is discharged from the outlet (15). When the intake float is lowering following the lowering of the water level, the contractible link (18) is forced into the link (19), till the float arm (23) presses the upper flange of the link (19). Then, the link (19) moves downward. Through the pressing of the crank (26) against the coupling (20), the control block (21) is rotated clockwise and the control plate (14) swings downward and covers the outlet (15) which stops the water flow as shown in FIG. 2(*b*). Since the head of the positioning block (5) is within the concave water level scale (3), whenever the water level scale (3) is turned, since the width of each flange is 30° and that of each projection (6) is 15°, the range of turning is 135°. The more it is turned clockwise, the more the slider (17) is slid leftward, then the greater the projection of link (18) from the link (19), the more the lowering of the water level before the discharge plate closes and thus, the greater the discharge volume. When the scale is turned fully 135°, the water discharge if 100% of water content in the tank. Therefore, the invention is a device which can be adjusted for discharge volume optionally. Action of each part of the invention is illustrated in FIG. 3. Whenever termination of discharge is required during flushing, only the water level scale has to be turned till the link (18) is fully contracted into the link (19) and then, the arm (23) of the intake control float (24) forces the control block to move outward through the lowering of water level, and thus the control plate (14) slides away from the flange of the control block (21) and closes the outlet for termination of water discharge. Therefore, the purpose of water saving is attained.

I claim:

1. A stepless controlled water tank for a flush toilet comprising a tank having at its bottom an outlet opening, a pivoted closure for said outlet opening, a pivoted control lever for releasably holding said closure in open position, a low level float connected with said control lever and acting by its flotation to position said control lever to hold said closure in open position when the water level is above a predetermined low level, an operating lever shaft rotatably mounted in said tank above normal high water level and extending to the outside of said tank, an operating handle outside said tank fixed to said shaft, an arm on said shaft inside said tank, linkage connecting said arm with said closure to open said closure by operation of said handle, whereupon said closure is held open by said control lever, a high level float on an arm pivotably mounted in said tank at approximately high water level, a slider slidable longitudinally on said float arm, lost-motion means connecting said slider with said control lever, volume discharge control means including a setting member on the outside of said tank, and means connecting said discharge control member with said slider to move said slides to different positions along said float arm, whereby said high water float, as it descends during discharge of water from said tank, acts through said slides and said means connecting said slides with said control means to release said closure to close said outlet at a time depending on the position of said slides on said float arm.

2. A water tank according to claim 1, in which said volume discharge control means comprises a hollow shaft coaxial with said operating lever shaft and an arm on said hollow shaft, said setting member being fixed on an outer end of said hollow shaft and said arm being connected with said slider.

3. A water tank accoding to claim 1, in which said control lever comprises a two-arm L-shaped lever having on a first arm detent means engageable with said closure in open position and, on a second arm, said low level float, said slider being connected with said record arm.

4. A water tank according to claim 1, in which said lost motion connection comprises two telescopically interfitting parts, one connected with said slider and another connected with said control lever.

* * * * *

UNITED STATES PATENT AND TRADEMARK OFFICE

CERTIFICATE OF CORRECTION

PATENT NO. : 4,296,505

DATED : October 27, 1981

INVENTOR(S) : Chiang Chien-Sheng

It is certified that error appears in the above—identified patent and that said Letters Patent is hereby corrected as shown below:

On The Title Page, the inventor's name should appear as follows:

-- Chien-Sheng Chiang --.

Signed and Sealed this

*Second* Day of *February 1982*

[SEAL]

*Attest:*

GERALD J. MOSSINGHOFF

*Attesting Officer*

*Commissioner of Patents and Trademarks*